United States Patent [19]

Heilskov

[11] Patent Number: 4,471,854

[45] Date of Patent: Sep. 18, 1984

[54] MARINE LADDER

[75] Inventor: Jens A. Heilskov, Wilmington, N.C.

[73] Assignee: Sidewinder International, Ltd., Wilmington, N.C.

[21] Appl. No.: 456,627

[22] Filed: Jan. 10, 1983

[51] Int. Cl.[3] ..... E06C 1/56

[52] U.S. Cl. ..... 182/196; 182/228

[58] Field of Search ..... 182/196, 197, 198, 199, 182/73, 74, 75, 228, 46

[56] References Cited

U.S. PATENT DOCUMENTS

| | | | |
|---|---|---|---|
| 800,934 | 10/1905 | McArthur | 182/198 |
| 1,349,125 | 8/1920 | Full | 182/196 |
| 2,638,260 | 5/1953 | Skolmen | 182/196 |
| 3,008,537 | 11/1961 | Roberts | 182/196 |
| 3,329,238 | 7/1967 | Guldi | 182/198 |
| 4,241,809 | 12/1980 | Salvarezza | 182/199 |

*Primary Examiner*—Reinaldo P. Machado
*Attorney, Agent, or Firm*—Wood, Dalton, Phillips, Mason & Rowe

[57] ABSTRACT

A flexible embarkation-debarkation marine ladder having a pair of flexible wire rope suspension members. A plurality of steps are secured to the suspension members at spaced intervals. The steps include a pair of ears. The opposite ends of the rungs are secured to the ears in spaced relationship. Each ear includes a tubular sleeve extending perpendicularly to and in aligned relationship to the spacing between the rungs. The suspension member extends coaxially through the sleeves. A plurality of constrictible annular stops are fixed to the suspension member at the opposite ends of the sleeves to lock the steps to the suspension member in parallel, spaced relationship. In another form, the marine ladder suspension members are formed of a pair of fiber ropes. The fiber ropes extend through rectangular tubular sleeves which are fixedly secured to the ears as by welding. The steps and spreader arms of the fiber rope ladder are secured to the fiber rope elements by constrictible sleeves above and below the sleeves of the respective step and spreader arm mounting structures.

21 Claims, 8 Drawing Figures

FIG. 1
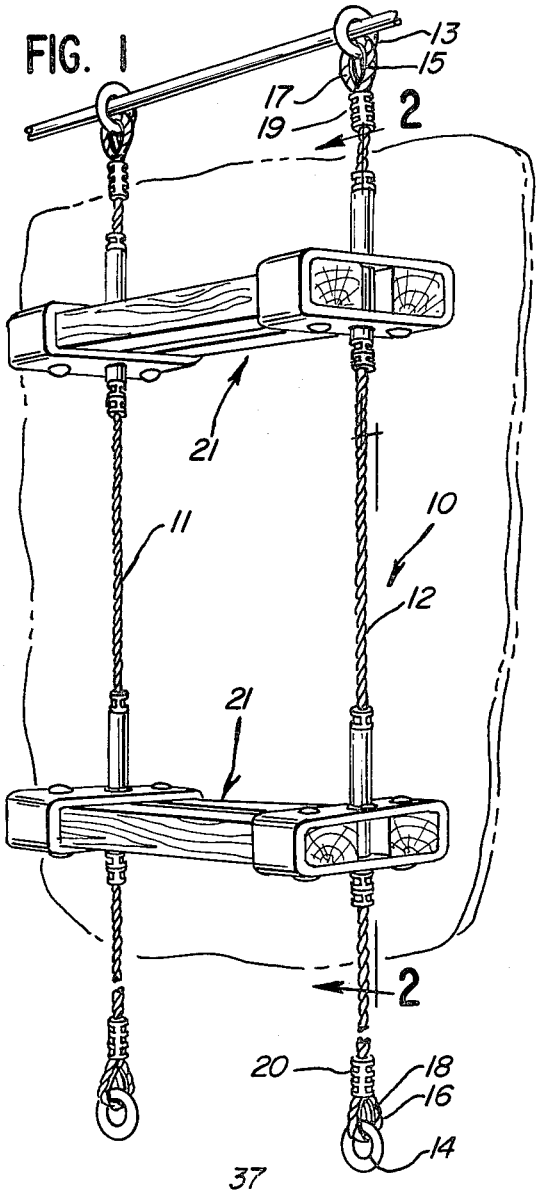
FIG. 2
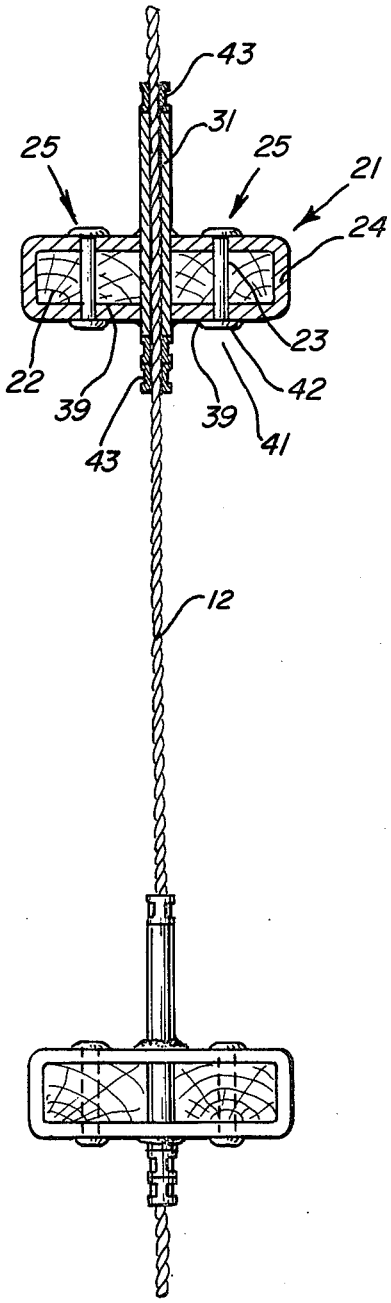
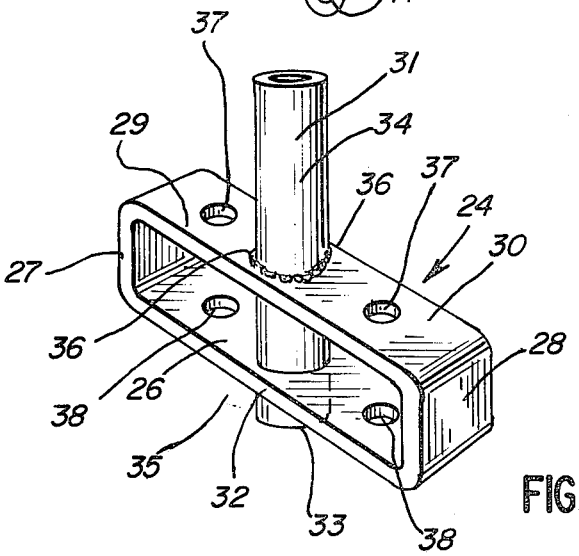
FIG. 3

FIG. 4
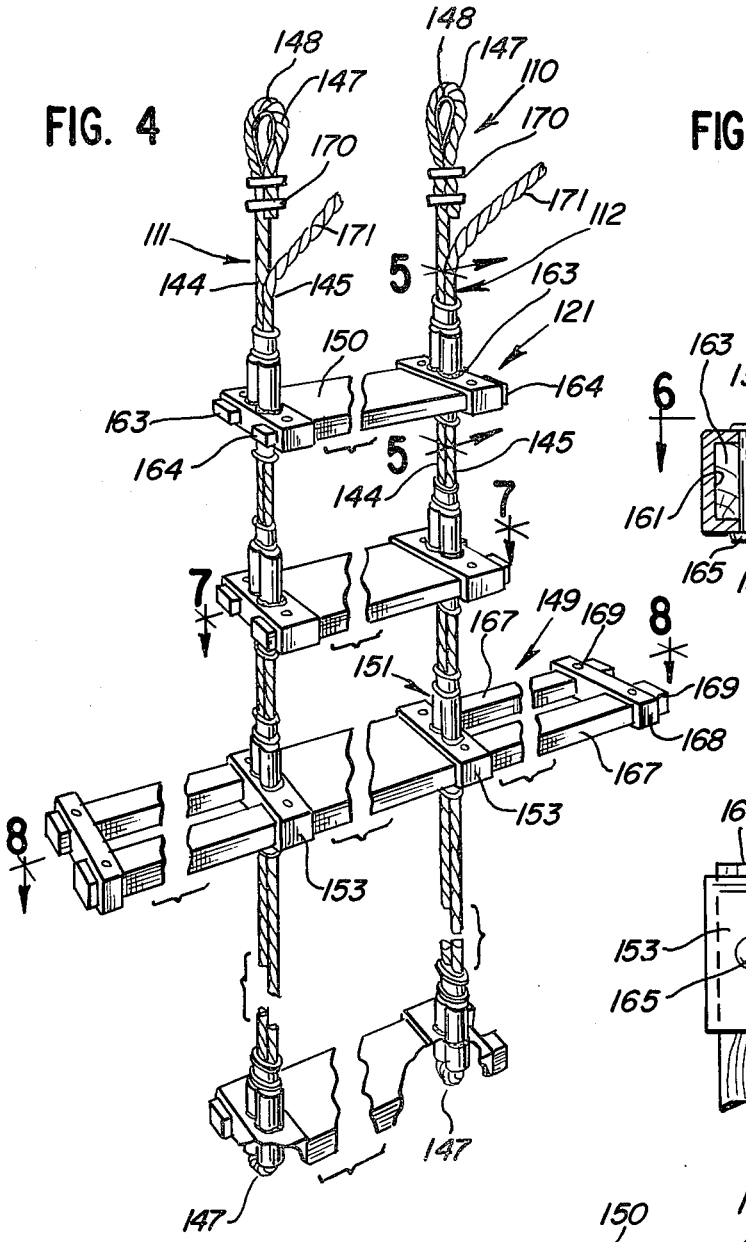
FIG. 5
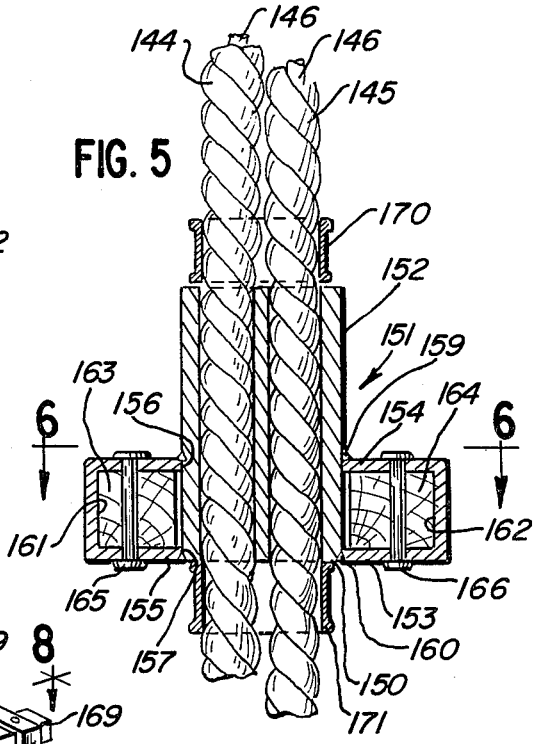
FIG. 6
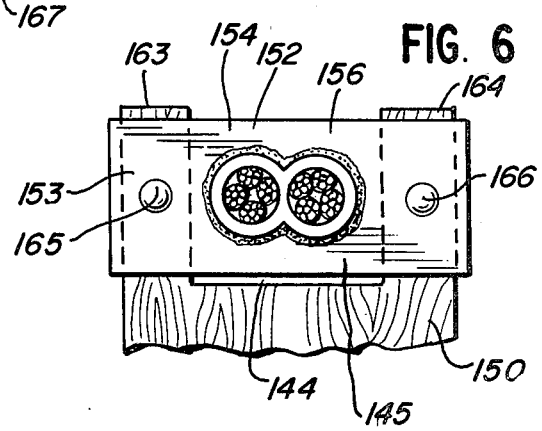
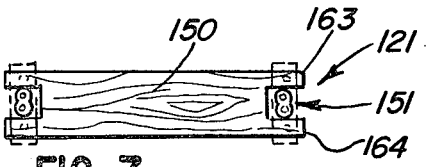
FIG. 7
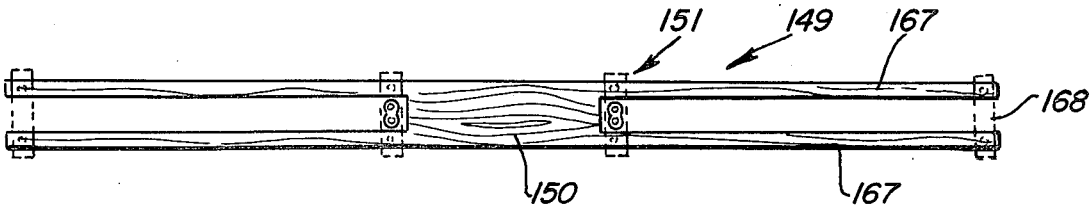
FIG. 8

MARINE LADDER

BACKGROUND OF THE INVENTION

1. Field of the Invention

This invention relates to flexible embarkation-debarkation marine ladders.

2. Description of the Background Art

Chain ladders have been utilized for embarkation-debarkation service in marine applications, such as in emergencies. Such ladders are constructed for use by being hung to extend downwardly along a vertical portion of a vessel's hull.

In the conventional chain ladders, single loop, lock-link coil chains are conventionally employed.

Conventionally, the spacing between the chains is in the range of 16 to 19 inches. The top step of the ladder is conventionally approximately 24 inches from the upper end of the chain to which is attached a flashing ring.

The steps of the conventional marine ladder include two rungs providing both handhold and stepping surfaces. In the coventional marine ladders, the distance between the steps is in the range of 12 to 15 inches. The rungs are conventionally formed of wood or equivalent material, and conventionally have a width of at least $1\frac{1}{2}$ inches and a thickness of between 1 and $1\frac{1}{2}$ inches. The rungs are spaced apart a distance between 1 to $1\frac{1}{2}$ inches and are supported on the chain in such a manner as to prevent rotation. The rungs are arranged to extend horizontally when the ladder is hung vertically.

The ladder is arranged to take a static load on the steps of 700 lbs. and the chains are constructed to jointly support a static load of 2,000 lbs.

A typical embarkation-debarkation ladder is illustrated in drawing 160.017 of the U.S. Coast Gaurd, entitled "Type II Embarkation-Debarkation Ladder".

A number of such ladders built in conformity with the requirements of the Department of Transportation, United States Coast Guard, are commercially available.

One example of a rope ladder for such use is illustrated in U.S. Pat. No. 4,241,809, of Robert M. Salvarezza. As shown therein, the ladder utilizes a pair of side ropes with steps formed as a molded, one-piece hard elastomer member.

SUMMARY OF THE INVENTION

The present invention comprehends improved embarkation-debarkation ladders which are extremely simple and economical of construction while yet providing high strength, long life ladder structures adapted for such rigorous marine use.

More specifically, in one form, the invention comprehends the provision of a flexible embarkation-debarkation marine ladder including a pair of flexible wire rope suspension members, a plurality of steps each defined by a pair of rungs, a pairs of ears, means for securing one end of the rungs in spaced relationship to one ear, means for securing the opposite end of the rungs in spaced relationship to the other ear, and a pair of tubular sleeves fixed one each to the ears to extend perpendicularly to and in aligned relationship to the spacing between the rungs, the wire rope suspension members extending coaxially through said sleeves, and a plurality of constrictible annular stops fixed to the wire rope suspension members, one each at opposite ends of the sleeves to lock the steps to the suspension members in parallel spaced relationship at preselected positions along the length of the suspension members.

In the illustrated wire rope ladder embodiment, the sleeves extend intermediate the spaced rungs and have a length substantially greater than the thickness of the rungs.

Each ear of the illustrated wire rope ladder is provided with a central opening and one end of the sleeve is secured to the ear in alignment therewith.

In one form, the ear comprises a U-shaped member having legs provided with inturned distal ends.

In the illustrated embodiment, the sleeve end is connected to the bight of the ear, with the sleeve extending outwardly between the inturned distal ends. The sleeve is secured to the opposed inturned distal ends. The rungs are removably secured to the ears by suitable threaded securing means.

In the illustrated wire rope ladder, the suspension members comprise galvanized metal cables having a synthetic resin coating.

In another form, the invention comprehends the provision of a flexible embarkation-debarkation marine ladder including a pair of flexible rope suspension members each comprising a pair of fiber ropes, a plurality of steps each defined by a midportion and a pair of spaced connecting portions at each end of the midportions, a pair of ears, means for securing one pair of the connecting portions to one ear, means for securing the opposite pair of the connecting portions to the other ear, and a pair of tubular sleeves fixed one each to the ears to extend perpendicularly to and in aligned relationship to the spacing between the paired connecting portions, the rope suspension members extending in side-by-side relationship through the sleeves, and a plurality of constrictible annular stops fixedly constricted about the pair of fibers ropes, one each at opposite ends of the sleeves, to lock the steps to the suspension members in parallel spaced relationship at preselected positions along the length of the suspension members.

In the illustrated embodiment, the fiber rope ladder sleeves are rectangular in transverse cross section and the annular stops are oval in transverse cross section.

In the illustrated fiber rope ladder, the ears and sleeves are formed of metal and the ears are welded to the sleeves.

Further in the illustrated fiber rope ladder, the ears define loop elements having opposite portions thereof provided with aligned openings for receiving the sleeves.

In the illustrated embodiment, the opposite portions of the loop elements comprise planar portions.

At opposite sides of the sleeves, the loop elements define spaces receiving the spaced connecting portions of the steps.

In one form, the connecting portions define outboard extensions projecting outwardly of the ears in spaced parallel relationship.

The distal ends of the extensions, in the illustrated embodiment, are provided with securing means for retaining the extensions rigidly in the spaced parallel relationship.

Thus, the marine ladder development of the present invention is extremely simple and economical of construction while yet providing a highly improved flexible ladder structure for use in embarkation-debarkation operations.

BRIEF DESCRIPTION OF THE DRAWING

Other features and advantages of the invention will be apparent from the following description taken in connection with the accompanying drawing wherein:

FIG. 1 is a fragmentary perspective view of a portion of a wire rope marine ladder embodying the invention;

FIG. 2 is a fragmentary side elevation thereof;

FIG. 3 is a perspective view of an ear for use in attaching the rungs thereof to the suspension members;

FIG. 4 is a fragmentary perspective view of a portion of another form of rope marine ladder embodying the invention;

FIG. 5 is a fragmentary enlarged longitudinal section taken substantially along the line 5—5 of FIG. 4;

FIG. 6 is a fragmentary cross section taken substantially along the line 6—6 of FIG. 5;

FIG. 7 is a cross section taken substantially along the line 7—7 of FIG. 4; and FIG. 8 is a cross section taken substantially along the line 8—8 of FIG. 4.

DESCRIPTION OF THE PREFERRED EMBODIMENTS

In the illustrative embodiment of the invention as disclosed in FIGS. 1–3 of the drawing, a marine ladder generally designated 10 is shown to comprise an embarkation-debarkation ladder including a pair of flexible wire rope suspension members 11 and 12. In the embodiment of FIGS. 1–3, the suspension members comprise $\frac{1}{4}''$, $7\times19$, vinyl-coated galvanized aircraft cables.

Each of the suspension members is provided with a pair of lashing rings 13 and 14 at the upper and lower ends thereof, respectively, as illustrated in FIG. 1. The lashing rings are secured to the ends of the cable by means of eye splices 15 and 16, respectively. Upper eye splice 15 is provided with a thimble 17 and lower eye splice 16 is provided with a thimble 18, permitting sliding engagement between the eye splice and the lashing ring. As shown in FIG. 1, the eye splices are secured by means of constricted $\frac{1}{4}''$ aluminum oval sleeves 19 and 20, respectively, and the lashing ring comprises a 3" i.d., $3\frac{3}{4}''$ o.d. $\frac{3}{8}''$ galvanized metal ring.

The ladder includes a plurality of steps generally designated 21, which are secured to the suspension members to be disposed in parallel, spaced relationship at preselected positions along the length of the suspension members. In conformity with the Coast Guard requirements, the uppermost step, in the illustrated embodiment, is spaced from the center of the lashing rings 13 a distance of 24 inches. The remaining steps, in the illustrated embodiment, are spaced apart uniformly a distance in the range of 12 inches to 15 inches.

In the illustrated embodiment, the spacing between the suspension members 11 and 12 is in the range of 16 inches to 19 inches. The suspension members are maintained in the preselected parallel, horizontally spaced relationship by the steps 21.

More specifically, each step 21 includes a pair of wooden rungs 22 and 23. The opposite ends of the rungs are secured to mounting ears 24. As shown in FIG. 1, the rungs are removably secured to the mounting ears by threaded securing means generally designated 25.

As illustrated in FIG. 3, each ear comprises a U-shaped member having a bight 26 and upstanding legs 27 and 28. Leg 27 is provided with an inturned distal end 29 and leg 28 is provided with an inturned distal end 30 extending in vertically spaced overlying relationship to bight 26.

A tubular sleeve 31 extends through an opening 32 in bight 26 to have a lower portion 33 extend downwardly from the bight and an upper portion 34 extend upwardly therefrom. The sleeve is fixedly secured to the bight in alignment with opening 32 by a suitable weld 35.

As further shown in FIG. 3, the sleeve upper portion 34 is secured to the distal leg ends 29 and 30 by suitable welds 36 to provide a positive, rigid connection of the sleeve to the ear.

As shown in FIG. 3, suitable openings 37 are provided in the distal ends 29 and 30 in alignment with openings 38 in the bight 26 for extension of the threaded securing means 25 therethrough. As shown in FIG. 2, the rungs are provided with through bores 39 to be disposed in alignment with openings 37 and 38 to accommodate the threaded securing means. In the illustrated embodiment, the threaded securing means comprises threaded bolts 41 and cooperating nuts 42.

The respective ears are secured to the suspension members at the desired locations along the length of the suspension members by means of a plurality of $\frac{1}{4}''$ aluminum button stops 43. As shown in FIG. 2, one such button stop 43 is constricted to the suspension member at the desired location for the upper end of the sleeve 31, and a pair of such button stops is secured to the suspension member at the desired location for the lower end so as to capture the sleeve 31 therebetween and thereby retain the step in the desired location on the suspension member.

In the illustrated embodiment, ear 24 has a width of approximately $5\frac{1}{2}''$. The rungs comprise wooden rungs having a length of 23 inches and a square cross section of $1\frac{1}{2}''$ on each side. The rungs are spaced apart a distance of $1\frac{1}{2}''$ and are provided with 5/16" holes for accommodating $\frac{1}{4}''\times2''$ bolts of the securing means 25. The ears may be formed of a suitable strong rigid material, such as metal or hard synthetic resin.

The suspension members are substantially wearfree, avoiding the problems attendant the use of manila or synthetic resin ropes. The use of the wire cable suspension members avoids the problem of kinking of the prior art chain devices, and permits facilitated storage and ready availability for use when needed, such as during emergency operations. The use of the wire cable suspension members provides strength far surpassing the required load tests and provides long troublefree life of the ladder.

Referring now to FIGS. 4–8, a modified form of marine ladder generally designated 110 is shown to comprise a marine ladder generally similar to marine ladder 10 but wherein the suspension members comprise pairs of fiber ropes 144 and 145. Each of the ropes may comprise a conventional $\frac{3}{4}''$ rope formed of a substantially nonmetallic material, such as polyester synthetic resin, e.g., Dacron®, manila hemp, etc. Alternatively, each fiber rope may comprise a rope formed of polyester fibers with a polypropylene core 146. The rope preferably should have a high strength, such as capable of supporting 5400 lbs. or more.

As shown in FIG. 4, rope lengths 144 and 145 may be formed of a continuous length of rope having a loop 147 at the lower end suitably secured by a lowermost oval press sleeve 148. As shown in FIG. 4, the suspension members generally designated 111 and 112 are each defined by a pair of side-by-side fiber rope portions 144 and 145, one portion of which defines an upper eye splice 147 provided with a metal thimble 148.

As further shown in FIG. 4, each loop 147 is secured by an upper press sleeve 170 illustratively comprising a 7/8"×1½" oval press sleeve. The distal end 171 of the rope length 145 extends free and may have a suitable preselected length, such as 10 feet.

The marine ladder includes a plurality of steps generally designated 121 and spreader arms generally designated 149. Each of the steps 121 and spreader arms 149 defines a midportion 150. The steps and spreader arms are mounted to the suspension members 111,112 in parallel, spaced relationship at preselected positions along the length of the suspension members. The means for mounting the steps and spreader arms to the suspension members is similar and is more specifically illustrated in FIGS. 5 and 6.

As shown in FIG. 5, the mounting means generally designated 151 comprises a tubular sleeve 152 receiving the rope lengths 144,145 in side-by-side relationship therein. As shown in FIG. 6, sleeve 152 may comprise an oval tube. Sleeve 152, as shown in FIGS. 5 and 6, is fixedly secured to an ear 153. Ear 153 comprises a loop element which, as seen in FIG. 5, is generally rectangular in transverse section. The loop element may be formed of a metal tube defining opposite planar portions 154 and 155 provided with aligned openings 156 and 157.

As shown in FIGS. 5 and 6, sleeve 152 extends through upper opening 156 to have its lower end 158 received in the lower opening 157, and in the illustrated embodiment, terminates flush with planar bottom portion 155. The sleeve is secured to the ear by suitable welds 159 at top planar portion 154 and bottom planar portion 155, respectively.

The extension of sleeve 152 through the middle portion of the loop ear effectively causes the ear to define opposite, internal spaces 161 and 162.

Each of steps 121 defines, at opposite ends of midportion 150 thereof, a pair of connecting portions 163 and 164 received respectively in ear spaces 161 and 162. The connecting portions are secured to the ears by suitable rivets 165 and 166, respectively, as shown in FIG. 5.

As shown in FIG. 4, spreader arms 149 are similarly secured to ears 153 in a similar manner. However, as shown in FIGS. 4 and 8, the spreader arm connecting portions define extensions 167 which are maintained in outwardly extending, spaced, parallel relationship by a securing ring 168 at their distal ends. The securing ring is secured to extensions 167 by suitable rivets 169.

The steps 121 and spreader arms 149 are maintained in vertically spaced, parallel relationship at preselected positions along the length of the suspension members 111 and 112 by means retaining the sleeves of the mounting means 151 thereof fixedly to the suspension members. More specifically, as shown in FIG. 5, each sleeve 152 is locked in position on the suspension member by means of an upper constrictible annular stop 170 and a lower constrictible annular stop 171. The stops, in the illustrated embodiment, comprise 7/8" heat-treated aluminum oval ferrules which are suitably compressed, or constricted, into positive retained engagement on the fiber rope suspension members. Thus, the stops 170,171 cooperate in locking the sleeve in accurately preselected disposition on the suspension members.

In the illustrated embodiment of marine ladder 110, the ears are formed of 6063-T6 aluminum alloy rectangular tubing. In the illustrated embodiment, each ear 153 has a length of approximately 4⅞", a height of approximately 1½", a wall thickness of 0.125", and a width of approximately 1½". The sleeve is formed of oval tubular aluminum alloy. In the illustrated embodiment, the sleeve 152 has a length of approximately 3¾", a width of approximately 1⅞", a height of approximately 1⅛", and a wall thickness of approximately 0.250". The rivets are 3/16" diameter rivets having a length of approximately 1⅝" and are formed of semitubular 6063-T6 aluminum.

The steps and spreader arms are formed of 4½" wide by 1⅛" thick American hardwood, such as oak or ash wood, having suitable wood preservative material applied thereto and finished with a nonskid surface as by application of epoxy WP70 to the upper surface of the midportion thereof. The steps are approximately 21" long and the wooden spreader arms are approximately 70" long. The construction provides a 16" clearance between the suspension members, with a 13" clearance between the respective steps and between the steps and spreader arms.

The fiber rope ladder 110, like the metal rope ladder 10, is extremely simple and economical of construction while yet providing a long life, troublefree marine ladder construction.

The foregoing disclosure of specific embodiments is illustrative of the inventive concepts comprehended by the invention.

I claim:

1. A flexible embarkation-debarkation marine ladder comprising:

a pair of flexible wire rope suspension members;

a plurality of steps each defined by a pair of rungs, a pair of ears, means for securing one end of the rungs in spaced relationship to one ear, means for securing the opposite end of the rungs in spaced relationship to the other ear, and a pair of tubular sleeves fixed one each to said ears to extend perpendicularly to and in aligned relationship to the spacing between said rungs, said wire rope suspension members extending coaxially through said sleeves, each said ear comprising a U-shaped member having legs provided with inturned distal ends, the sleeve having one end connected to the bight of the ear and extending outwardly between said inturned distal ends; and a plurality of constrictible annular stops fixed to said wire rope suspension members, one each at opposite ends of said sleeves to lock the steps to said suspension members in parallel spaced relationship at preselected positions along the length of said suspension members.

2. The marine ladder of claim 1 wherein said sleeves extend intermediate said spaced rungs.

3. The marine ladder of claim 1 wherein said sleeves have a length substantially greater than the thickness of the rungs in the direction perpendicular to the spacing therebetween.

4. The marine ladder of claim 1 wherein said sleeves have a length a number of times greater than the thickness of the rungs in the direction perpendicular to the spacing therebetween.

5. The marine ladder of claim 1 wherein each said ear is provided with a central opening and one end of the sleeve is secured to the ear in alignment with said opening.

6. The marine ladder of claim 1 wherein said sleeve is secured to said inturned distal ends.

7. The marine ladder of claim 1 wherein each said ear comprises a U-shaped member having legs provided with inturned distal ends, said rung ends being received between the bight and inturned distal ends of the ear.

8. The marine ladder of claim 1 wherein each said ear comprises a U-shaped member having legs provided with inturned distal ends, said rung ends being received between the bight and inturned distal ends of the ear, said means for securing the rungs to the ears comprising means for removably securing said rungs to said ears.

9. The marine ladder of claim 1 wherein each said ear comprises a U-shaped member having legs provided with inturned distal ends, said rung ends being received between the bight and inturned distal ends of the ear, said means for securing the rungs to the ears comprising means for removably securing said rungs to said ears comprising threaded securing means extending through said turned distal ends, said rung end, and said bight.

10. The marine ladder of claim 1 further including a pair of upper lashing rings, a pair of upper thimbles connected one each to one end of the suspension members, said upper lashing rings being movably secured one each to said upper thimbles, a pair of lower lashing rings, and a pair of lower thimbles connected one each to the opposite end of the suspension members, said lower lashing rings being movably secured one each to said lower thimbles.

11. The marine ladder of claim 1 wherein said suspension members are provided with eye splices at their opposite ends, said thimbles being mounted to said eye splices.

12. The marine ladder of claim 10 wherein said suspension members are provided with eye splices at their opposite ends, said thimbles being mounted to said eye splices, said eye splices being secured by constricted metal oval sleeves.

13. A flexible embarkation-debarkation marine ladder comprising:

a pair of flexible rope suspension members each comprising a pair of fiber ropes;

a plurality of steps each defined by a midportion and a pair of spaced connecting portions at each end of the midportion, a pair of ears, means for securing one pair of the connecting portions to one ear, means for securing the opposite pair of the connecting portions to the other ear, and a pair of tubular sleeves fixed one each to said ears to extend perpendicularly to and in aligned relationship to the spacing between the paired connecting portions, said rope suspension members extending in side-by-side relationship coaxially through said sleeves, each said ear comprising a U-shaped member having legs provided with inturned distal ends, the sleeve having one end connected to the bight of the ear and extending outwardly between said inturned distal ends; and a plurality of constrictible annular stops fixedly constricted about said pair of fiber ropes, one each at opposite ends of said sleeves, to lock the steps to said suspension members in parallel spaced relationship at preselected positions along the length of said suspension members.

14. The marine ladder of claim 13 wherein said sleeves are rectangular in transverse cross section.

15. The marine ladder of claim 13 wherein said annular stops are oval in transverse cross section.

16. The marine ladder of claim 13 wherein said ears and sleeves are formed of metal and said ears are welded to said sleeves.

17. The marine ladder of claim 13 wherein said ears define aligned openings for receiving said sleeve.

18. The marine ladder of claim 13 wherein said ears define loop elements having opposite planar portions thereof defining said bight and distal ends.

19. The marine ladder of claim 13 wherein said ears define loop elements, said sleeve extends between laterally opposite portions of the loop elements to define a pair of spaced spaces receiving said spaced connecting portions of the steps.

20. The marine ladder of claim 13 wherein said ears define loop elements, said sleeve extends between laterally opposite portions of the loop elements to define a pair of spaced spaces receiving said spaced connecting portions of the steps, and said connecting portions define outboard extensions projecting outwardly from said ears in spaced, parallel relationship.

21. The marine ladder of claim 13 wherein said ears define loop elements, said sleeve extends between laterally opposite portions of the loop elements to define a pair of spaced spaces receiving said spaced connecting portions of the steps, and said connecting portions define outboard extensions projecting outwardly from said ears in spaced, parallel relationship, securing means being provided at the distal ends of the extensions to retain the extensions rigidly in said spaced parallel relationship.

* * * * *